US008499801B2

(12) United States Patent
Wild et al.

(10) Patent No.: US 8,499,801 B2
(45) Date of Patent: Aug. 6, 2013

(54) METHOD AND APPARATUS FOR FILLING LIQUIDS INTO FOIL BAGS WITH A SPOUT

(75) Inventors: Hans-Peter Wild, Eppelheim (DE); Eberhard Kraft, Neckarbischofsheim (DE)

(73) Assignee: INDAG Gesellschaft für Industriebedarf mbH & Co. Betriebs KG, Eppelheim (DE)

( * ) Notice: Subject to any disclaimer, the term of this patent is extended or adjusted under 35 U.S.C. 154(b) by 1990 days.

(21) Appl. No.: 11/443,655

(22) Filed: May 30, 2006

(65) Prior Publication Data

US 2006/0278302 A1 Dec. 14, 2006

(30) Foreign Application Priority Data

Jun. 10, 2005 (EP) ..... 05012577

(51) Int. Cl.
*B65B 1/04* (2006.01)

(52) U.S. Cl.
USPC ..... 141/10; 141/65; 141/114; 141/302; 141/315

(58) Field of Classification Search
USPC ..... 141/1, 4–8, 10, 57, 59–61, 65, 66, 141/98, 114, 166, 285, 301, 302, 313, 315
See application file for complete search history.

(56) References Cited

U.S. PATENT DOCUMENTS

| | | | | |
|---|---|---|---|---|
| 3,799,219 A * | 3/1974 | Uth et al. | ..... | 141/39 |
| 4,077,182 A | 3/1978 | Papaluca et al. | | |
| 4,493,349 A | 1/1985 | Pomponio, Sr. et al. | | |
| 4,832,096 A | 5/1989 | Kohlbach et al. | | |
| 5,437,316 A | 8/1995 | McPherson et al. | | |
| 5,823,388 A * | 10/1998 | Green | ..... | 222/1 |

FOREIGN PATENT DOCUMENTS

| | | |
|---|---|---|
| EP | 0 894 723 A | 2/1999 |
| EP | 1 129 949 A | 9/2001 |
| JP | 2001-58697 | 3/2001 |

OTHER PUBLICATIONS

Official Action, dated Oct. 25, 2007, in Russian Patent Appln No. 2006113735/11, which is the counterpart to the subject application.
Euopean Patent Office Search Report, dated Nov. 24, 2005, in patent appln. No. EP 05 012577.2.
Office Action from the Patent Office Chile, May 30, 2006.

* cited by examiner

*Primary Examiner* — Jason K Niesz
(74) *Attorney, Agent, or Firm* — Stroock & Stroock & Lavan LLP

(57) ABSTRACT

The present invention relates to a method for filling liquids into foil bags (2) with a spout (3), the method comprising the steps of: mounting the spout (3) on a filling orifice (4); evacuating the foil bag (2) through the spout (3); filling the foil bag (2) with the liquid through the spout (3); sucking liquid out of the filling orifice (4); discharging a sterile gas through the spout (3) into the foil bag (2). Furthermore, the present invention relates to an apparatus (1) for filling liquids into foil bags (2) with a spout (3), the apparatus (1) comprising: a filling orifice (4) for mounting the spout (3) of the bag (2) on the filling orifice (4) in a spout position; a liquid path (29, 30) which leads from a liquid supply line (5) to the filling orifice (4), the liquid path (29, 30) being adapted to be shut off with a filling valve (6); a gas path (32, 33) which leads from a gas supply line (23, 24) to the filling orifice (4), a gas valve (9) being provided in the gas path (32, 33), and the gas path (32, 33) terminating downstream of the filling valve (6) in the liquid path (29, 30), and the gas supply line (24, 23) being connectable either to a vacuum line (27) or to a sterile gas line (28).

19 Claims, 4 Drawing Sheets

METHOD AND APPARATUS FOR FILLING LIQUIDS INTO FOIL BAGS WITH A SPOUT

TECHNICAL FIELD OF THE INVENTION

The present invention relates to a method for filling liquids into foil bags, the foil bags comprising a spout.

BACKGROUND OF THE INVENTION

Various methods and apparatuses for filling liquids into foil bags including a spout are known from the prior art.

The known methods have the drawback that the exterior of the spout is sometimes wetted by the liquid.

It has been found that this entails a number of drawbacks. For instance, one drawback is that liquid present on the exterior of the spout and thus on the exterior of the bag has the effect that the bag gets soiled or tacky. On the other hand, this might create a hygienic problem because the externally adhering liquid is not protected by the sterile packaging of the bag.

It is therefore the object of the present invention to provide a method and an apparatus for preventing wetting of the spout on the outside. This object is achieved by a method according to claim 1 and by an apparatus according to claim 9.

Advantageous embodiments are disclosed in each of the subclaims.

SUMMARY OF THE INVENTION

According to the invention liquid is sucked out of the filling orifice after the foil bag has been filled. This prevents subsequent dripping of liquid onto the outside of the spout upon removal of the spout. After the liquid has been sucked off, furthermore a sterile gas shot is discharged into the film bag, so that said bag gets slightly inflated, and the liquid level and thus foam that might be present in the bag descend downwards into the bag. This prevents leakage of foam or liquid via the spout.

Each of these measures as such is suited for achieving an improvement in the prevention of an undesired wetting of the outside of the spout with liquid.

Furthermore, the foil bag is evacuated prior to filling. This prevents the formation of foam inside the foil bag for a great part, so that foam can also not leak out of the spout after the filling process and might wet the spout on the outside.

Furthermore, the head space existing in the bag that is filled with the gas and not with the liquid can be kept as small as possible due to the prevention of foam formation.

Advantageously, evacuation and discharge of the sterile gas are performed through one and the same line. This permits a simple construction of the corresponding apparatus.

For the evacuation of the bag advantageously a gas valve inside the apparatus is opened and the supply line to the gas valve is connected to a vacuum line, which can be carried out in the most efficient way by switching a corresponding switch valve.

The gas valve is advantageously closed for filling the bag and the filling valve is opened and closed after the filling process. This prevents liquid from being wasted by the liquid passing into the gas path.

For the suction process the filling valve is closed and the gas valve in the apparatus is opened and connected to a vacuum line. Possible liquid is thereby sucked out of the filling orifice in a very efficient and rapid way to prevent subsequent dripping.

For the sterile gas discharge the filling valve is closed and the gas valve in the apparatus is opened towards a compressed gas line by a switch valve. The use of the gas valve also for the supply of the sterile gas discharge provides a simple configuration of a corresponding apparatus that is as compact and mechanically simple as possible. With this procedure, liquid that might still be in the filling orifice is passed into the foil bag and the filling orifice remains below the filling valve without liquid, so that the bag with the spout can be removed without any subsequent dripping.

In the apparatus, a gas path is provided that extends between a gas supply line and the filling orifice, a gas valve being provided in the gas path to shut off or to open the gas path, and the gas path terminating downstream of the filling valve in the liquid path. This makes it possible to remove liquid positioned downstream of the filling valve in the dosed state of the filling valve. The gas supply line is connected to a vacuum line or a sterile gas line so that liquid or gas can either be sucked off through the vacuum line, or sterile gas can be supplied. It is thereby possible to permit evacuation and supply of gas through only one line. This permits a compact construction of the apparatus.

The filling valve preferably comprises a movable piston which can be pressed against a tapering pipe part in the liquid path to open or close the liquid path with a seal. This permits an exact control of the filling operation.

Furthermore, it permits a preferred embodiment in which the gas path is arranged inside the movable piston. The gas path can thus terminate directly downstream of the filling valve in the liquid path.

The gas valve preferably comprises a plunger that is moveable relative to an opening, so that the gas valve can be opened or closed through movement of the plunger. This permits fast opening and closing, as is needed for high filling capacities.

In a preferred embodiment, a liquid return means is provided in the liquid path upstream of the filling valve. The liquid return means is capable of returning the liquid to the container from which the liquid is passed through a liquid supply line to the spout position. Since the liquid return means is provided upstream of the filling valve, the liquid can be circulated through the liquid return means in the closed state of the filling valve.

This is of particular advantage whenever the liquid to be filled should be in a hot state (for reasons of sterility) because in such a case, while the apparatus is in a stopped state where no filling takes place, no liquid will cool down in the area of the apparatus and would then be filled at a temperature that is too low.

The liquid return means can also be used for circulating cleaning liquid.

BRIEF DESCRIPTION OF THE INVENTION

Advantageous embodiments are illustrated with reference to the attached drawings, in which.

DETAILED DESCRIPTION OF PREFERRED EMBODIMENTS

Figure 1:
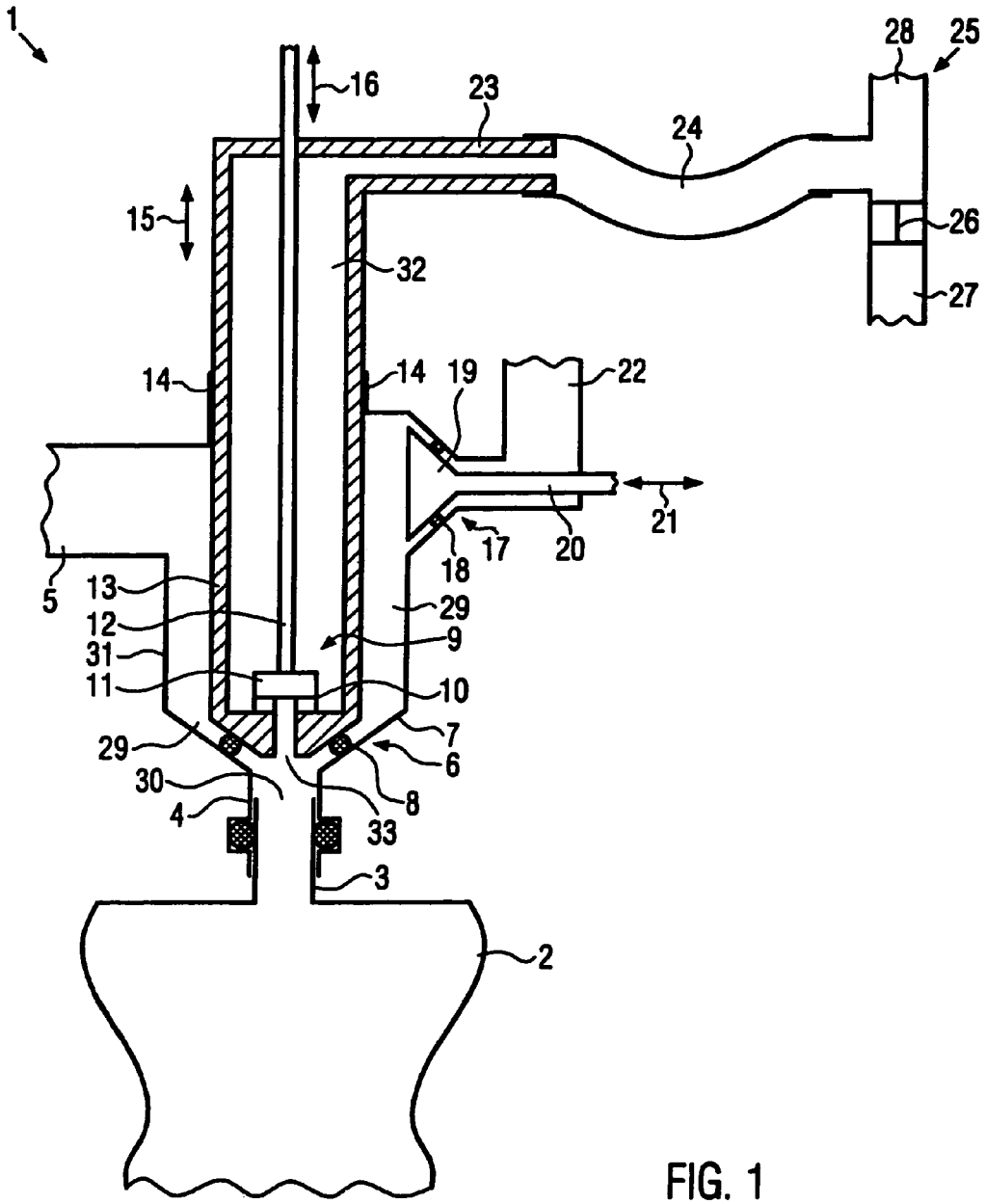
FIG. 1 shows an apparatus used for filling, in a schematic sectional drawing.

FIG. 1 shows an apparatus 1 for filling foil bags 2 with a spout 3. The spout 3 of the foil bag 2 is mounted on a filling orifice 4. The spout 3 may here be inserted from below either into an opening or it can be pulled over an opening, such as a small pipe.

A liquid supply line 5 is arranged at the side of the main pipe 31. The main pipe 31 extends in a direction transverse to the liquid supply line 5 in a vertical orientation up to the filling orifice 4. The lower end of the main pipe 31 has a conical inside 7.

A filling valve 6 is provided above the filling orifice 4. The filling valve 6 comprises an annular seal 8 which can be pressed against the conical inside 7. The seal 8 is here arranged on a movable piston 13 which can be moved up and down in direction 15. The seal 8 can also be arranged on or in the conical inside.

FIG. 1 shows the piston 13 in its lower position in which the seal 8 rests on the inside 7, thereby representing a closed filling valve 6.

The liquid path extends between the liquid supply line 5 and the filling orifice 4 over the portions 29 and 30. Portion 29 is provided upstream of the filling valve 6 and portion 30 downstream of the filling valve 6. Portions 29 and 30 can be sealed relative to each other through the filling valve 6.

The main pipe 31 is provided at its upper end with guides 14 for the piston 13. This ensures an exact movement of the piston 13 in direction 15. In the area of the guide 14, corresponding seals must be provided for the piston 13, so that no liquid can exit between piston 13 and guide 14.

A cavity 32 is formed in the interior of the piston 13. The lower end of the cavity 32 can be closed with a gas valve 9. The gas valve 9 comprises a seal 10, which is an annular seal in this instance. The annular seal 10 surrounds the upper end of an opening 33 which is located in the lower end of the piston 13. The lower end of the opening 33 terminates in the portion 30 of the liquid path.

A plunger 10 can be mounted on the seal 10 for closing the opening 33 relative to the cavity 32. The plunger 11 is here arranged on a piston rod 12 which can be moved up and down in direction 16. The piston rod 12 exits through the upper end of the cavity 32 to the outside and must there be sealed accordingly.

FIG. 1 shows the plunger 11 in a lower position, so that the gas valve 9 is closed. The upper end of the cavity 32 is connected via a line 23 to a switch valve 25. When the piston 13 is moved in direction 15, line 23 is moved along with said piston. It is therefore of advantage to provide a flexible connection line 24 between switch valve 25 and line 23, so that the switch valve 25 can be stationary. The switch valve 25, however, could also be made movable along with piston 13.

The switch valve 25 can connect line 23 and 24, respectively, to a vacuum connection 27 or to a sterile air supply line 28. To this end an appropriate slide 26 is provided in the switch valve 25 for connecting the line 24 to the connection 27 or 28 and for closing the respectively other connection. However, it is also possible to use any other three-way valve which selectively interconnects two paths.

The piston 13 and the piston rod 12 can be displaced in direction 15 and direction 16, respectively, with the help of pneumatic cylinders, electric motors or other electric actuators, or via mechanical drives, such as cams, or the like. Hydraulic actuators are also feasible.

From portion 29 a liquid return means 22 is branched off from the main pipe 31. Said return means can be shut off with a return valve 17. The return valve 17 comprises a cone 19 which can be pressed in direction 21 against the inside of the main pipe 31. The main pipe may here also be provided on its inside with a correspondingly matching cone. The cone 19 can be reciprocated via a rod 20 in direction 21 to open or close the return valve 17. The return means 22 is arranged opposite to the inlet 5.

The procedure during the filling process shall now be explained in the following. In FIG. 1, the liquid valve 6 and the gas valve 9 are closed. In this state, a foil bag 2 with a spout 3 can be mounted on the filling orifice 4. This state is shown in FIG. 1.

Figure 2:
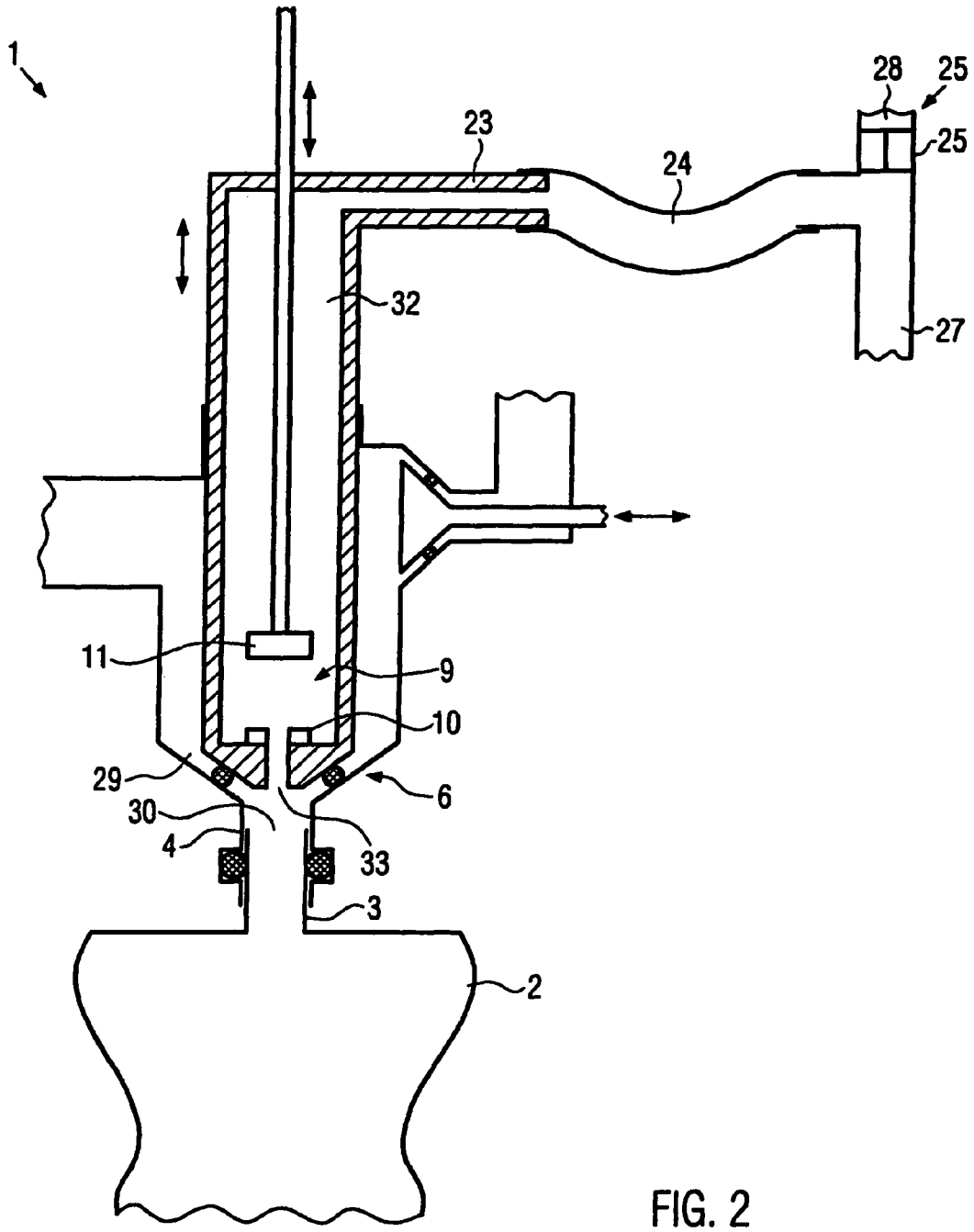
FIGS. 2 to 4 show the apparatus of FIG. 1 in different operative states.

As shown in FIG. 2, the switch valve 25 is switched such that the line 23 is connected to the vacuum connection 27. A vacuum is thereby produced in cavity 32. Furthermore, gas valve 9 is opened. The interior of cavity 32 is connected through opening 33 to the filling orifice 4. The foil bag 2 is thus evacuated through the spout 3. The filling valve 6 is here closed. Upstream of the filling valve 6 in portion 29, however, liquid is already present now.

After the bag 2 has been evacuated for a period of about 1/10 to 2/10 or 5/10 second or also one second, the gas valve 9 is closed by lowering the plunger 11. This state is shown in FIG. 1. The bag is evacuated in this state and remains in the evacuated state.

Figure 3:
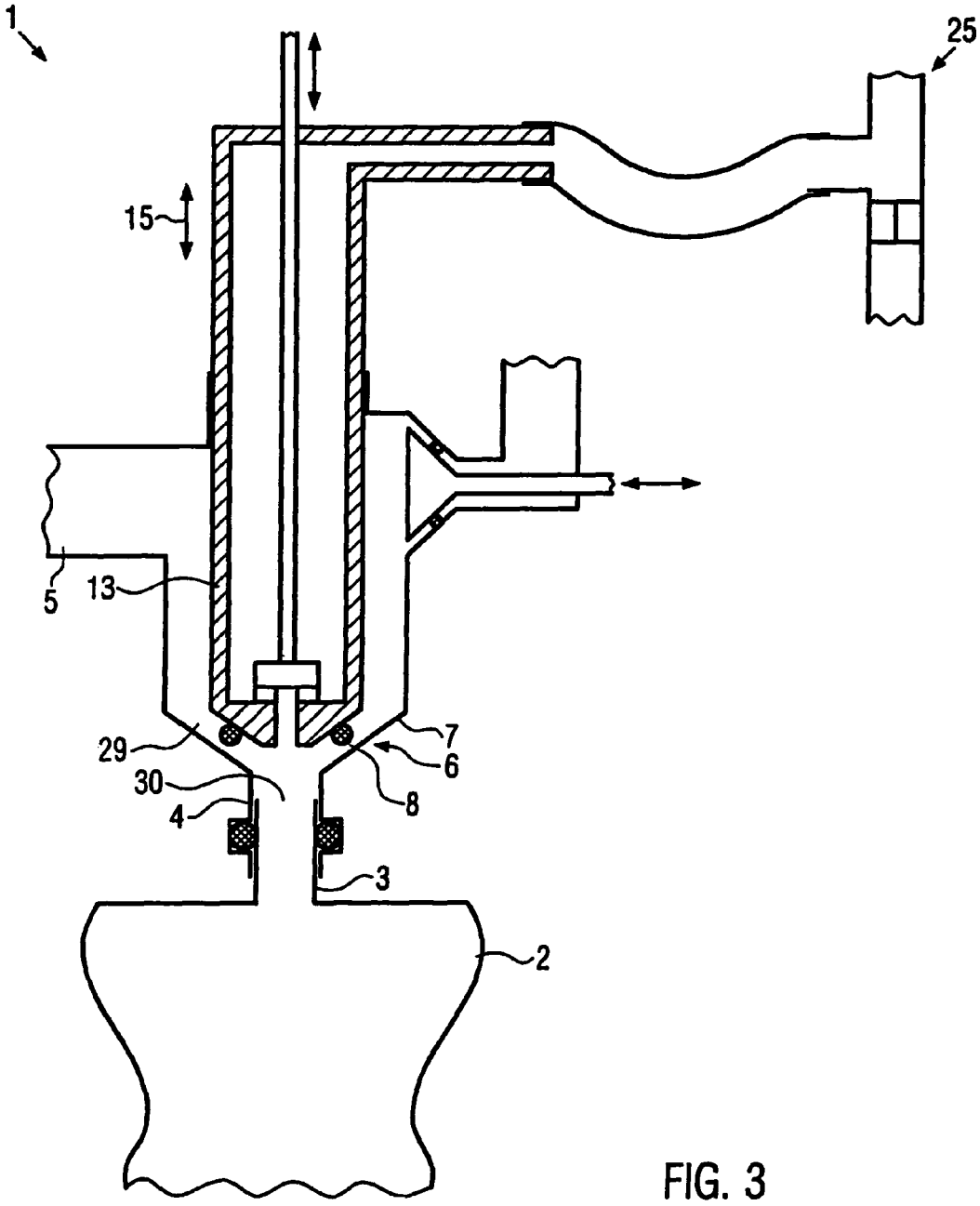

As shown in FIG. 3, the filling valve 6 is subsequently opened. To this end the piston 13 is moved upwards in direction 15. As a consequence, seal 8 detaches from the conical inside 7, so that the liquid path between liquid supply line 5 and filling orifice 4 is opened.

In this process the liquid passes through the liquid supply line 5 into the portion 29, 30 and from there through the spout 3 into the foil bag 2. In the supply line 5, a volume meter may be arranged that senses the filled amount of liquid and terminates the filling operation in such a way that the preset filling amount is filled.

For terminating the filling operation the piston 13 is moved downwards in direction 15, so that the seal 8 is seated on the inside 7, as a result of which the filling valve 6 is closed. This state is shown in FIG. 1.

In chamber 30, liquid is still found in the filling orifice 4. This liquid can be sucked off by opening the gas valve and by correspondingly switching the switch valve 25 (see FIG. 2). The liquid from portion 30 is sucked off through the opening 33 into the cavity 32 and from there through the line 23, 24 and the switch valve 25 into the vacuum connection 27. The corresponding valve position is shown in FIG. 2. Preferably, only a few drops of liquid are here removed.

Figure 4:
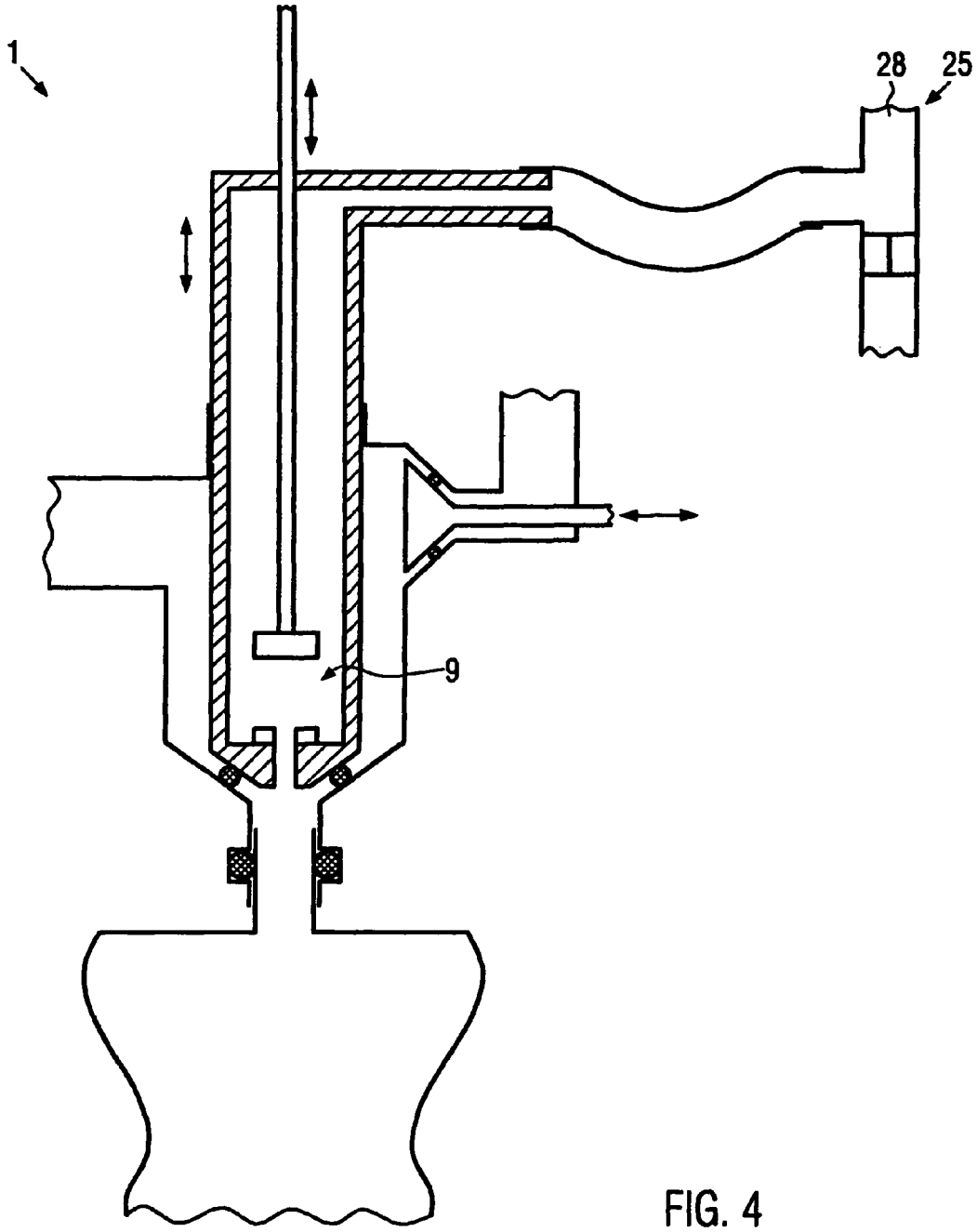

After the process of sucking liquid out of the filling orifice 4 has been completed, the switch valve 25 can be switched, so that the line 23, 24 is connected to the sterile air connection 28 (see FIG. 4). The gas valve 9 can here remain open. Sterile air will then pass through line 23, 24 into cavity 32 and from there through the opened gas valve 9 into opening 33 and into portion 30. The sterile air passes from there through spout 3 into the foil bag 2. On the one hand, sterile air passes in this way into bag 2, so that the interior remains sterile. On the other hand, the liquid level in the foil bag 2 is lowered. Leakage of liquid during removal of the bag 2 with the spout 3 from the filling orifice 4 is thereby rendered more difficult. This state is shown in FIG. 4.

After liquid has been sucked out of the filling orifice, it is however only possible to close the gas valve 9 upon operation of the switch valve 25, so that the line 23, 24 is first connected to the sterile gas connection 28 and the gas valve 9 is then opened again.

The steps of sucking liquid out of the filling orifice 4 and of discharging sterile gas could also be carried out in reverse order. This has the advantage that air which only contains a few liquid drops is substantially found in the area of the filling orifice 4, so that liquid is entrained by the air being sucked off.

Moreover, it is possible that the sucking operation is carried out first and that sterile air is then discharged, and that the sucking operation is then performed again. Thereafter, it is also possible to discharge sterile air again. It is also possible to discharge sterile gas twice and to suck off liquid between the two steps.

The invention claimed is:

1. A method for filling liquids into foil bags comprising:

a filling orifice;

a spout of a foil bag, the spout being mounted on the filling orifice;

providing a vacuum source for evacuating the foil bags;

providing a sterile gas source;

providing a source supply line, the source supply line being selectively connectable to the vacuum source or the sterile gas source;

providing a cavity extending from the filling orifice to the source supply line to define a joint gas path;

providing a selecting valve being disposed on the source supply line for selecting the vacuum source or the sterile gas source to which the source supply line is to be connected;

providing a gas valve, wherein at least a portion of the gas valve is located within the cavity, on the joint gas path, and upstream from the filling orifice; and the gas valve including a displaceable plunger disposed in the joint gas path for selectively opening and closing the joint gas path and the cavity above the filing orifice in response to the plunger being displaced;

evacuating the foil bag via the joint gas path;

filling the foil bag, through the filling orifice and spout with the liquid;

removing liquid from the filling orifice via the joint gas path; and discharging the sterile gas via the joint gas path.

2. The method according to claim 1, further comprising creating a vacuum in the foil bag prior to filling the foil bag with the liquid.

3. The method according to claim 1 wherein the selecting valve is a switch valve.

4. The method according to claim 1, further comprising introducing the sterile gas into the foil bag after removing liquid from the filling orifice.

5. The method according to claim 1, further comprising creating a vacuum in the foil bag and introducing a sterile gas into the foil bag via the joint gas path.

6. The method according to claim 1, comprising operating the selecting valve to select the vacuum source and opening the gas valve.

7. The method according to claim 1, further comprising closing the gas valve located upstream from the filling orifice and opening a filling valve located upstream from the filling orifice prior to filling the foil bag with the liquid.

8. The method according to claim 7, further comprising closing the filling valve to stop filling the foil bag with the liquid.

9. The method according to claim 1, further comprising:

operating the selecting valve to select the vacuum source;

opening the gas valve located upstream from the filling orifice; and closing a filling valve located upstream from the filling orifice before removing liquid from the filling orifice.

10. The method according to claim 4, further comprising:

operating the selecting valve to select the vacuum source;

opening the gas valve located upstream from the filling orifice; and a filling valve located upstream from the filling orifice that is constructed and arranged to be closed before introducing the sterile gas into the foil bag.

11. The method according to claim 1, further comprising introducing the sterile gas into the foil bag prior to removing the liquid from the foil bag.

12. The method according to claim 1, further comprising introducing the sterile gas into the foil bag after removing the liquid from the foil bag.

13. An apparatus for filling liquid into a foil bag having a spout, the apparatus comprising:

a filling orifice constructed to be selectively introduced into a spout of a foil bag;

a liquid supply line;

a pipe part extending from the liquid supply line to the filling orifice defining a liquid path through which liquid can flow;

a filling valve having an open position wherein the liquid can flow to the filling orifice the filling valve further comprising a movable piston having an opened position and a closed position wherein the liquid is prevented from flowing to the filling orifice;

a vacuum source;

a sterile gas source;

a source supply line, the source supply line being selectively connectable to the vacuum source or the sterile gas source;

a cavity formed within the piston, the cavity extending from the filling orifice to the source supply line to define a joint gas path;

a selecting valve being disposed on the source supply line for selecting the vacuum source or the sterile gas source to which the source supply line is to be connected; and a gas valve, the gas valve including a displaceable plunger disposed in the joint gas path for selectively opening and closing the gas path and the cavity above the filing orifice in response to the plunger being displaced, wherein at least a part of the gas valve is located within the cavity in the piston.

14. The apparatus of claim 13, wherein the gas valve being located upstream from the filling orifice.

15. The apparatus of claim 13, wherein the liquid can flow past the filling valve when the piston is in the opened position and the liquid is prevented from flowing past the filling valve when the piston is in the closed position.

16. The apparatus of claim 15, further comprising a tapered pipe enclosing the piston, wherein the piston engages the tapered end of the pipe when the piston is in the closed position.

17. The apparatus of claim 15, wherein the joint gas path is at least partially located within the piston.

18. The apparatus of claim 13, further comprising a liquid return element and a return valve, wherein the return element and the return valve are located upstream from the filling valve, the return valve being constructed and arranged to selectively shut off the liquid return element.

19. The apparatus of claim 13, wherein the filling valve is located upstream from the filling orifice.

* * * * *